United States Patent [19]

Di Giacomo

[11] 4,347,125

[45] Aug. 31, 1982

[54] SORTING OF ORES WITH DETECTABLE COMPOUNDS

[75] Inventor: Peter M. Di Giacomo, Mission Viejo, Calif.

[73] Assignee: Occidental Research Corporation, Irvine, Calif.

[21] Appl. No.: 100,618

[22] Filed: Dec. 5, 1979

[51] Int. Cl.[3] ..... B07C 5/02

[52] U.S. Cl. ..... 209/3.3; 209/578

[58] Field of Search ..... 209/3.1, 3.2, 3.3, 1, 209/3, 4, 9, 578, 576

[56] References Cited

U.S. PATENT DOCUMENTS 3,356,211 12/1967 Mathews ..... 209/3.1

3,901,793 8/1975 Buchot ..... 209/1

4,208,273 6/1980 Moudgil ..... 209/3.3

*Primary Examiner*—Allen N. Knowles

*Attorney, Agent, or Firm*—Barry A. Bisson; Robert Franks

[57] ABSTRACT

A process for separating ore particles from gangue particles comprises the steps of (1) conditioning the particles with an agent comprising a compound having both a surface-selective functional group and a detectable moiety, to selectively coat either the ore particles or the gangue particles, to the substantial exclusion of the other; (2) detecting the coated particles; and (3) separating the detected, coated particles from the substantially uncoated particles. In one embodiment, the detectable moiety is fluorescent and detecting is performed under ultraviolet radiation.

20 Claims, No Drawings

SORTING OF ORES WITH DETECTABLE COMPOUNDS

CROSS REFERENCE TO RELATED APPLICATIONS

This application is related to U.S. Pat. Nos. 3,356,211; 3,472,375; 3,722,676; and 4.169,045; and to the following commonly owned, copending U.S. Pat. application Nos: 897,740 filed Apr. 19, 1978, now U.S. Pat. No. 4,208,272 issued June 17, 1980; 897,779 filed Apr. 19, 1978, now U.S. Pat. No. 4,208,273 issued June 17, 1980; 897,780 filed Apr. 19, 1978, now U.S. Pat. No. 4,207,175 issued June 10, 1980; 897,946 filed Apr. 19, 1978; 897,947 filed Apr. 19, 1978, now U.S. Pat. No. 4,235,708 issued Nov. 25, 1980; 36,637 filed May 7, 1979; and 45,185 filed June 4, 1979. Each of these patents and applications is hereby incorporated by reference.

BACKGROUND OF THE INVENTION

This invention relates to compounds which contain both a surface-selective functional group and a detectable moiety, such as one which will fluoresce under ultraviolet light, and the use of such compounds in selectively coating certain components of a mixture of ore particles to the substantial exclusion of other particles. The detectable portion can have a visible color, can fluoresce, can emit radiation, or can be induced (as by further chemical reaction or exposure to electromagnetic radiation or sub-atomic particles) to exhibit a characteristic property. The invention is particularly well suited for use with a mechanical apparatus for sorting ore particles, such as an electro-optical separator.

U.S. Pat. No. 3,356,211 to Mathews describes a method for concentrating ore which involves preferentially coating the desired particles with a liquid fluorescent material, subjecting the ore to electromagnetic radiation so that at least the coated portion will fluoresce, and sensing the characteristic fluorescent wavelength emitted by the irradiated particles.

U.S. Pat. No. 3,472,375 to Mathews describes an apparatus which senses the emitted fluorescent radiation from gangue or ore particles, especially coated particles, and separates by selectively directing streams of a fluid to cause those fluorescent particles to be removed from the remaining quantity of undesired ore.

Successful operation of a mechanical sorting device such as that of Mathews is dependent upon the ability to selectively coat either gangue or ore particles which contain a particular mineral component, while not coating the other particles to a significant extent. The surface chemical properties of a specific ore or gangue particle depend upon the minerals which are present in that particle and, since the composition of individual particles can show a wide variation, the surface chemical properties of the particles will also vary.

To utilize a difference in surface chemical properties in the separation of ore particles, it is necessary to contact the mixture of particles with a surface-selective agent which will selectively react with certain mineral species present in the particles, due to the selectivity of the reagent in distinguishing between surface chemical properties. The reaction may be chemical, physical or a combination of those types. This process is referred to herein as "conditioning."

Methods of particle separation in which it is necessary to condition the particles include flotation separation and optical separation. In flotation separation, the particles to be separated are conditioned with a flotation agent, which coats the ore particles with which it is reactive and creates a hydrophobic mineral surface. When air bubbles are attached to this hydrophobic surface, the coated particles can be floated away from uncoated particles.

For an optical separation, the mixture of particles is conditioned with a suitable surface-selective reagent and either a coloring agent or a fluorescent material, depending upon the nature of the separation process. One example of a separation using a coloring agent is the method of U.S. Patent Application Ser. No. 897,947, filed Apr. 19, 1978, now U.S. Pat. No. 4,235,708 issued Nov. 25, 1980, and titled "Method of Separating a Mixture of Ore Particles."

The procedure for applying a coating to ore particles for an optical separation usually involves application of the fluorescent or coloring agent in one of three forms: precipitated in an aqueous or non-aqueous slurry, dissolved in an organic conditioning reagent (which may be then dispersed in an aqueous medium prior to application), or direct application of the agent (either alone, in solution, or dispersed in an aqueous medium) after a conditioning reagent has been applied to the particles.

U.S. Pat. No. 3,346,111 to Thompson et al, which is incorporated herein by reference, describes a method for rendering asbestos contained in a host rock differentially fluorescent in relation to the rock. A fluorescent dye is precipitated to form a gelatinous slurry, into which the asbestos-containing particles are dipped. Some quantity of the suspension is entrained in exposed asbestos fibers, giving those particles which contain more asbestos a higher fluorescent than the particles with less asbestos.

U.S. patent application Ser. No. 897,740, filed Apr. 19, 1978, now U.S. Pat. No. 4,208,272 issued June 17, 1980, and titled "Separation of Limestone from Limestone Ore" describes various methods for selectively coating limestone particles, or gangue particles which do not contain major amounts of limestone, with a fluorescent dye. For selectively coating limestone, a carboxylic acid such as oleic acid or caprylic acid is used as the coupling agent. If it is desirable to coat the siliceous gangue particles, an aliphatic amine is used as the coupling agent. The application contemplates either combining a fluorescent dye with the coupling agent prior to conditioning the ore particles or applying a fluorescent dye to the conditioned particles. However, the preferred method is to combine the coupling agent and fluorescent dye prior to conditioning, both to realize a lower dye consumption and to simplify the process.

Examples of processes for the separation of oil shale particles may be found in U.S. Pat. No. 4,169,045 and in U.S. patent application Ser. No. 45,185, filed June 4, 1975. An example of a process for the separation of coal particles in U.S. patent application Ser. No. 897,779, filed Apr. 19, 1978, now U.S. Pat. No. 4,208,273 issued June 17, 1980.

U.S. Pat. No. 3,901,793 to Buchot, et al, which is incorporated herein by reference, describes a three-step process for applying a fluorescent coating to mineral particles, involving a preconditioning by washing with water plus a wetting and a scouring agent, treating with a collector ("second conditioning"), and finally applying the fluorescent reagent.

The selection of conditioning agents and coloring or fluorescing agents is of utmost importance in developing a sorting process for a particular ore, utilizing one of the previously described systems.

Excluding the disclosure of U.S. Pat. No. 3,346,111, previously noted, which is a purely mechanical entrainment of fluorescent dye suspension by asbestos fibers, the foregoing references show the use of mixtures of coupling agents (which selectively bond to the desired ore particles) with fluorescent or coloring agents or the sequential application of a coupling agent and a mutually compatible fluorescent or coloring agent. When mixtures are contemplated, they comprise either solutions or dispersions (including emulsions) of coupling agent and fluorescent or coloring agent in an aqueous or organic carrier, depending upon the nature of the components.

Ordinarily, the coupling agent and the fluorescent or coloring agent are both insoluble in water so that subsequent steps, such as rinsing to remove the weakly adhering coating from undesired ore particles, will not greatly remove the coating from desired particles. The control of washing conditions can significantly improve the selectivity of a separation. However, if it is desired to provide a dye to particles which are selectively non-coated with the coupling agent to the substantial exclusion of the coated particles, a water-insoluble coupling agent and a water-soluble dye, or a water soluble coupling agent and a water-insoluble dye can be used.

Such contact between aqueous media and water-insoluble materials can result in the unwanted formation of emulsions. Emulsions which form can be particularly difficult to remove, since the fine ore particles which are produced during crushing to the desired size range cannot always be completely removed by pre-washing, and these particles are incorporated into the emulsions, thereby increasing the emulsion stability. This has the effect of causing difficulties in the handling of process streams and preventing the recycling of materials in the process.

U.S. Pat. No. 2,560,425 to Fancher describes the preparation of the choleretics having the formula Ar-$CO(CH_2)_nCOOH$, in which Ar is either fluoranthyl or tetrahydrofluoranthyl, and n is 2 or 3. U.S. Pat. No. 2,773,091 to Burtner relates to similar derivatives of fluoranthene in which the $(CH_2)_n$ function is expanded to include bivalent, aliphatic hydrocarbon radicals containing up to 8 carbon atoms.

These references are examples of fluorescent molecules (fluoranthene and tetrahydrofluoranthene) which have been provided with specific functional groups (carboxy and oxocarboxy). Such compounds, and the processes for their preparation, can be useful in the practice of the present invention.

SUMMARY OF THE INVENTION

According to the present invention, there is provided a process for the separation of higher grade ore particles from lower grade ore particles and/or gangue particles, in which the particles are subjected to a conditioning step wherein the conditioning agent comprises a compound having both a surface-selective functional group and a detectable, e.g. fluorescent moiety, causing the desired fraction of the particles to become selectively coated with the agent to the substantial exclusion of the other fraction or fractions, irradiating the mixture of particles to cause fluorescence in the coated particles so that they may be distinguished from the uncoated particles, and separating the fluorescing, coated particles from the uncoated particles. The invention also comprises certain novel compositions of matter and the processes for their preparation.

The fraction of particles which is selectively coated can be either the higher grade material or the lower grade material, as determined by the choice of conditioning agent.

Instead of fluorescence, other detectable properties may be imparted to the coated particles, including radioactivity, visible color, or the ability to exhibit characteristic properties upon stimulation by external electromagnetic radiation, subatomic particles or chemical reactions, by choice of a detectable moiety having the desired property.

DETAILED DESCRIPTION OF THE INVENTION

The process of the present invention is based upon those differences which exist in the surface chemical properties of the various components present in ores. Due to these differences, there can be selected a surface-selective agent or a mixture of surface-selective agents which will effectively and selectively coat only certain components present in an ore. A separation based upon surface chemical properties provides relatively more consistent separation results than do separation methods based upon other properties, such as color, reflectance and conductivity. Such other properties generally tend to be substantially similar for the various components of an ore, such that a fine degree of resolution is required in order to distinguish between these properties for the various materials present in an ore. Such a fine degree of resolution may be difficult to obtain and, for this reason, the efficiency of separation based upon these properties suffers.

In the practice of the method of this invention as regards a particular mineral ore, the ore is first subjected to a crushing step. In this crushing step, the ore is crushed to physically separate the components present within the ore. For example, some ores exist with stratifications and/or pockets of the various components and crushing of the ore as mined is a means for physically separating these stratifications and/or pockets. Crushing also increases the surface area of the particles, thereby providing a greater reactive site with which the surface-selective agent can react. The ore is crushed, typically to a particle size of from about one-quarter inch to about eight inches. Particle sizes of less than one-quarter inch can be used in the practice of this invention. However, such sizes require greater amounts of surface agent and are more difficult to separate, requiring greater amounts of time for separation for a given mass of ore. Particle sizes of greater than eight inches can be used in the practice of this invention but generally such particle sizes entrain such a substantial mixture of components that separation efficiency decreases. It is preferred to use ore particles of a size from about one-half inch to about three inches. Following the crushing and sizing steps, the ore particles can be deslimed to remove soluble impurities and surface fines which can be present on the particulate ore.

The ore is conditioned following sizing with a surface-selective agent or a mixture of surface-selective agents that selectively adheres to one of the components present in the ore to the substantial exclusion of adhering to the other components present. The surface-selective agent is used in sufficient quantity to provide a thin film on the components of the ore towards which the surface-selective agent is reactive. Due to the surface chemical property of the components the surface-selective agent reacts only with the selected components within the ore.

The ore is conditioned with the surface-selective agent by mixing the surface-selective agent in a surface-reactive relationship with the particulate ore. Conditioning of the ore with the agent is accomplished by contacting the particulate ore with the surface-selective agent. Many techniques are available for contacting a particulate solid with a liquid reagent. Such techniques include dipping the solid particles into a liquid bath containing the surface-selective agent, spraying the surface-selective agent onto the solid particles, mixing the solid particles with the surface-selective agent, and the like. It is preferred to spray the sized ore with the liquid reagent. Spraying techniques include, but are not limited to, spraying onto the ore as the ore passes the spray nozzle on a vibrating screen or belt, or spraying the ore as it passses through a ring sprayer or a series of ring sprayers. Such a technique is shown in U.S. patent application Ser. No. 897,946, filed Apr. 19, 1978 and titled "Method and Apparatus for Selective Wetting of Particles."

The surface-selective agent can be used in any suitable manner such as in solution, suspension, dispersion, or by itself. It is preferred to form a solution or dispersion of the surface-selective agent in water. Such a solution or dispersion can be readily coated on the ore particles and water is an economical and readily available carrier. The particulate ore is passed through such an aqueous bath to condition the ore with the surface-selective agent. In the bath the surface-selective agent interacts with those particles of the ore having surface chemical properties that are receptive to the surface-selective agent. Following the aqueous bath, the particulate ore is washed with an aqueous wash to remove excess surface-selective agent, weakly adhering surface-selective agent and any surface-selective agent entrained within the particulate ore. In some cases, it is possible to eliminate the washing step if the conditioning bath is sufficiently dilute.

Some gradation in the amount of coating on the particles is normally observed, due to the nonhomogeneity which is common to naturally occurring ore deposits. Typically, the crushing operation will not completely free the desired ore component from the gangue: particles will range in composition from nearly pure ore to nearly pure gangue material, including various mixtures of the components.

If the surface-selective agent is chosen for ore coating, the higher grade ore particles will be more heavily coated than the lower grade ore particles, and the more pure gangue particles will be substantially uncoated. Conversely, should the surface-selective agent be chosen to coat the gangue, the gangue particles will be more heavily coated than the lower grade ore particles, and the higher grade ore particles will remain substantially uncoated.

The relative degree of particle coating is usually related to the surface area in a given particle attributable to that component which is reactive toward the chosen surface-selective agent. A particle having a relatively higher percentage of the desired component will generally also have a relatively higher percentage of exposed surface area of that component, and will therefore accept a relatively larger amount of surface-selective agent.

To distinguish between the coated particles and the uncoated particles, the surface-selective agent chosen contains a detectable component such as a radioactive atom, a chromophore or a fluorescent moiety. The detectable component can also comprise a moiety which can be detected after further chemical reaction, as by exposure to radiation such as heat or light, pH changes, or redox reaction. The ore can then be sorted by radiation detection, by visible optical means or irradiated with electromagnetic radiation to induce fluorescence. In the latter case, the fluorescent surface-selective agent which coats some of the particles fluoresces, while the uncoated material does not fluoresce to any substantial degree. The different materials can be separated, based upon this property. It is also possible to separate various grades of ore, based upon the knowledge that the more heavily coated particles will possess a more intense color or fluorescence than will the less heavily coated particles. Conversely, a surface-selective agent can be used which will block ultraviolet radiation or which will absorb rather than reflect light. If a mechanical device is used to effect the separation, adjustment of the machine's sensitivity will alter the grade of ore product which is obtained.

The term "gangue" is used herein to include any mineral or assemblage of minerals other than that which is considered to be "ore" in a given separation procedure. In many instances, the gangue material contains minerals of economic interest, and therefore is not a discarded waste material, but may be subjected to a subsequent separation process which uses an agent having the ability to selectively coat an additional component. Should the recovery of other components be desired, further separations using different reagents may be used. From this, it can be seen that the terms "ore" and "gangue" have meaning only in terms of a specific separation to be performed: ore in a separation may be a component of the gangue from a previous separation.

Similarly, subsequent separation steps may be used to further separate the components of an "ore" fraction resulting from a procedure. This technique is useful in cases where a very pure ore mineral is desired and the additional expense of repeated processing to remove various impurities in a step-wise manner is not prohibitive, or in cases where a single surface-active agent does not provide the required selectivity for the desired separation to be conducted in one step. The term "ore" may be applied, therefore, to material which yields an ore fraction and a gangue fraction in a later separation.

Generally, fluorescence refers to the property of absorbing radiation at one particular wave-length and simultaneously re-emitting light of a different wavelength so long as the stimulus is active. It is intended in the present method to use the term "flourescence" to indicate that property of absorbing radiation at one particular wavelength and re-emitting it at a different wavelength, whether or not visible, during exposure to an active stimulus or after exposure or during both these time periods. Thus, fluorescence is used generically herein to include fluorescence, phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term electromagnetic radiation to indicate any and all stimuli that will excite and induce fluorescence of the flourescent dye. Thus, electromagnetic radiation is used generally herein and envisions other stimuli that will excite and induce fluorescence of the fluorescent dye.

If a property other than fluorescence is to be detected, external influences such as heat, radioactivity, or chemical stimuli, including oxidation, reduction, pH changes or salt formation can be utilized in producing a detectable property in the surface-selective agent.

It is preferable, but not essential, that the surface-selective agent be soluble in water to avoid the potential problems of emulsion formation within the system. This can be accomplished with the normally water-insoluble longer-chain organic compounds by utilizing their salts, especially alkali-metal salts, as surface-selective agents.

A further embodiment, which is considered to be within the scope of this invention, is the application of the fluorescent surface-selective agent to the particles in a dry state, e.g. "dusting" the particles with the agent. This can be accomplished either with or without an external driving force which facilitates the desired reaction between the agent and the surface of the particles, such as a technique analagous to electrostatic spray painting, in which an electrical charge would be imparted to the agent and an electrical charge of the opposite polarity given the particles, prior to the coating operation.

The selection of the surface-selective functional group in a fluorescent surface-selective agent is directed by the properties of the mineral species which are to be selectively coated by the agent, and the properties of the other species which are present in the mixture of particles. Reaction of the surface-selective functional group with a mineral surface, resulting in a physical adsorption or the formation of a new surface compound by chemical bonding is a likely mechanism by which the fluorescent moiety is attached to the surface of a particle.

The following table lists typical surface-selective compounds:

| Type | Formula |
|---|---|
| xanthate | ROCSSNa |
| dithiophosphate | $(RO)_2PSSNa$ |
| dithiocarbamate | $R_2NCSSNa$ |
| thiol (mercaptan) | RSH |
| thiocarbanilide | $(RNH)_2CS$ |
| carboxylic acid salts | RCOONa |
| arenesulfonate or alkylarenesulfonate | $RSO_3Na$ |
| alkyl sulfate | $ROSO_3Na$ |
| primary amine salt | $RNH_3Cl$ |
| quaternary ammonium salt | $RN(CH_3)_3Cl$ |
| alkylpyridinium salt | $RC_5H_4N.HCl$ |

Where Na appears in the above formulae, it may be replaced by any of the alkali metals if water solubility is desired, by an alkaline earth metal if oil solubility is needed, or by a transition metal such as aluminum or iron if a more insoluble compound is required for use in a dispersion.

The R in the above formulae is a group which contains a detectable moiety. The table provides a representative, though not exhaustive, list of the useful surface-selective groups which are contemplated in the present invention.

For those situations where fluorescence is the desired detectable property, R can be selected from such types of groups as polynuclear aromatics (including fluoranthene), xanthene dyes (fluorescein, rhodamine, etc.) dyes used for fabric whitening (coumarin derivatives, diaminostilbenedisulfonic acid-cyanuric chloride, distyrylbiphenyl, naphthotriazolystilbene, pyrazoline) and may other fluorescent groups.

For the practice of this invention, the primary requirement is that the detectable surface-selective agent attaches to the surface of a particle. Such surfactant types as cationics, anionics, nonionics, amphoterics, chelates, etc. can be used to advantage.

A variety of techniques are known in the practice of separations for increasing the selectivity of a collector. These techniques usually involve the use of modifying agents in combination with the collector, to influence the attachment of the collector onto the mineral surface. This invention relates to the selective attachment of surface-selective agents to mineral surfaces, and those techniques are included within the scope of this invention. The use of pH regulating agents, activators, depressants, dispersants, flocculants, and the like in combination with detectable surface-selective agents to achieve a desired selectivity is contemplated. Examples for the use of such modifying agents are contained within the literature of ore flotation, for example Taggart, *Handbook of Mineral Dressing* (1945), Section 12, which is incorporated herein by reference.

A further explanation of the invention is made by means of the following examples, which are not intended to be limiting, the scope of this invention being defined by the appended claims.

EXAMPLE I

After being informed that coworkers had discovered that limestone in the presence of silicate minerals can be selectively coated with a mixture of a carboxylic acid and a fluorescent dye (e.g. as in U.S. patent application Ser. No. 897,740, filed Apr. 19, 1978, now U.S. Pat. No. 4,208,272 issued June 17, 1980), carboxylic acid derivatives of fluoranthene were prepared using the following reaction I:

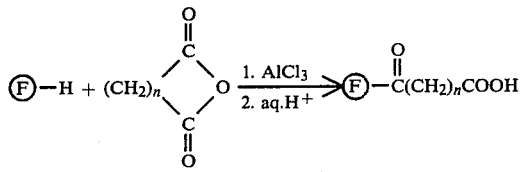

in which (F)—H is fluoranthene, $C_{16}H_{10}$, and n is 2,4 or 8. Portions of each product were reduced with hydrazine according to the following reaction II:

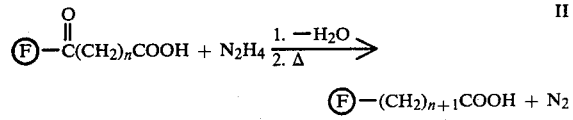

Since the free carboxylic acids as formed are insoluble in water, each product from I and II was converted to its sodium salt by reaction with sodium hydroxide.

Each of the six salts was dissolved in water and pieces of limestone ore were dipped into the solutions, then the pieces were irradiated with ultraviolet light. All of the compounds were found to coat the limestone in the particles, but the salts corresponding to the formulae were n equals two were found to be the more selective in not coating silicate minerals. In each case, the reduced compounds derived from reaction II exhibited a higher fluorescence intensity estimated visually, than the precursor from reaction I.

Based upon the above, and the superior solubility and rinsing characteristics exhibited, 4-(fluoranthyl)-butanoic acid, (F)—$(CH_2)3COOH$, was selected for further testing in the separation of limestone from siliceous gangue.

This example is typical of the procedure which is followed in selecting a fluorescent surface-active agent for use in selectively coating a given component of a mixture of ore particles.

EXAMPLE II

A 2000 ml round bottom flask was charged with 100 g of fluoranthene, 52 g of succinic anhydride and 1 liter of 2-nitropropane. The mixture was stirred and 157 g of aluminum chloride was added slowly, whereupon the temperature rose to about 50° C., then cooled to room temperature and stirred over a weekend.

The reaction mixture was hydrolyzed by pouring slowly into about 1 liter of about 3 N hydrochloric acid. Steam distillation was used to remove the solvent, and the solid residue was isolated by filtration with water washing. After transferring to a Soxhlet extractor, the solid was extracted into acetone.

The acetone extract was concentrated by distillation and 250 ml of deionized water was added, forming a slurry which dissolved after 800 ml of 2.5% sodium hydroxide was added. Upon acidification, the 4-(fluoranthyl)-4-oxobutanoic acid product precipitated and was collected by filtration. The product was partially dried under vacuum.

A 1000 ml flask was charged with 118 g of the partially dried product, above, and 43.7 g of potassium hydroxide, 39 ml of hydrazine hydrate, and 375 ml of diethylene glycol were added. The mixture was stirred and heated, during which excess water and hydrazine were collected and removed by means of a Dean-Stark trap, to a final temperature of about 195° C., and maintained at that temperature for about eight hours. After cooling and slurrying with 1500 ml of about 1.5 N hydrochloric acid, the 4-(fluoranthyl)-butanoic acid product was isolated by filtration and dried in a desiccator.

EXAMPLE III

A portion of the product from Example II was used, in a pilot plant based upon the apparatus of U.S. Pat. No. 3,472,375, for the separation of limestone from siliceous gangue. The 4-(fluoranthyl)-butanoic acid was converted to its sodium salt, which was dissolved in water to form a 0.1% by weight solution, and applied to the mixed ore and gangue particles by spraying. Following a rinse to remove excess reagent, the particles were passed through an electro-optical sorter which ejected the selectively coated ore particles to separate them from the substantially uncoated particles.

Six runs, totalling 1655 lb. of a limestone feed, were made using the fluorescent surface-active agent. The feed material was obtained from a manufacturer of portland cement, and consisted of reject material from a hand sorting of limestone ore, having the average analysis 87.40% $CaCO_3$, 7.38% $MgCO_3$, 0.45% $Fe_2O_3$ and 5.17% $SiO_2$.

The following results were obtained from these six runs, showing the concentrating of limestone feed by impurity removal.

| Run No. | Product of Stream | Distribution (% of total in feed) $CaCO_3$ | $MgCO_3$ | $Fe_2O_3$ | $SiO_2$ | Product % $CaCO_3$ |
|---|---|---|---|---|---|---|
| 100 | Lime Conc. | 79.2 | 73.3 | 28.8 | 54.9 | 88.51 |
| | Waste | 20.8 | 26.7 | 71.2 | 45.1 | 77.42 |
| 101 | Lime Conc. | 62.9 | 41.9 | 10.8 | 34.8 | 89.58 |
| | Waste | 37.1 | 58.1 | 89.2 | 65.2 | 76.58 |
| 102 | Lime Conc. | 83.0 | 69.3 | 46.5 | 48.8 | 89.51 |
| | Waste | 17.0 | 30.7 | 53.5 | 51.2 | 75.53 |
| 103 | Lime Conc. | 88.2 | 79.8 | 33.6 | 60.8 | 89.43 |
| | Waste | 11.8 | 20.2 | 66.4 | 39.2 | 74.05 |
| 104 | Lime Conc. | 85.9 | 77.1 | 46.5 | 59.3 | 89.06 |
| | Waste | 14.1 | 22.9 | 53.5 | 40.7 | 75.83 |
| 106 | Lime Conc. | 71.1 | 57.3 | 14.9 | 32.6 | 90.90 |
| | Waste | 28.9 | 42.7 | 85.1 | 67.4 | 77.07 |

As shown above, the limestone concentrate in each run was upgraded to between 88.51 and 90.90% $CaCO_3$. Significant amounts of iron and silica remained in the waste stream particles. Considerable variability was noted in the results between runs, attributable to the inhomogeneous nature of the ore particles and the relatively small (186 to 359 lb.) quantities of material which were processed in each run.

EXAMPLE IV

To prepare a fluorescent surface-selective agent for use in further separation testing, the procedure of Example II was repeated on a larger scale, as follows: a 12 liter reactor was placed in an ice bath, and 5 liters of 2-nitropropane, 700 g of fluoranthene and 365 g of succinic anhydride were added. After cooling the mixture to about 10° C., small portions of anhydrous aluminum chloride (totalling 1194 g, over a one hour period) and an additional 2 liters of 2-nitropropane were added. The temperature rose to about 20° C. during the ensuing reaction. After addition of the aluminum chloride, the bath was removed and the mixture stirred overnight. The mixture was hydrolyzed by the addition of one liter of 3 N hydrochloric acid, and the solids recovered by filtration. Acetone was used to extract the solids in a Soxhlet extractor, and the acetone solution was removed. After the addition of 3.6 liters of deionized water, acetone was removed by distillation, and the remaining 4-(fluoranthyl)-4-oxobutanoic acid was removed by filtration, yielding a 1.8 Kg wet cake.

A 905 g portion of the wet cake was placed in a three-neck flask with 1.1 liters of diethylene glycol, 2.5 equivalents of potassium hydroxide and 2.8 equivalents of hydrazine hydrate. The mixture was heated to remove water and excess hydrazine, then the temperature was raised to 190° C. After cooling, the mixture was poured into 3 liters of cold, 1 N hydrochloric acid, and the product, 4-(fluoranthyl)-butanoic acid dissolved in dilute sodium hydroxide solution, re-precipitated with aqueous hydrochloric acid, and collected by filtration.

EXAMPLE V

Pilot plant testing of the product from Example IV yielded unsatisfactory results, apparently because the fluorescent compound did not properly coat the ore particles. This was considered to be a result of significantly greater than normal impurity levels in the compound.

A 200 g portion of the product from Example IV was dissolved in 600 ml of toluene at a temperature near the boiling point of the solution. After decanting the solution away from the dark, tar-like insolubles, it was cooled, and a small amount of a dark oil was removed. The solution was contacted with two liters of 2.5% by weight sodium hydroxide solution in a separatory funnel, and the organic layer was discarded. The aqueous layer was acidified and the purified product was collected as a wet cake by filtration.

The pilot plant test of Example III was repeated, using the 4-(fluoranthyl)-butanoic acid purified above and feed material from the same lot as was previously used, yielding the following results for a total of 1228 lb. of limestone feed:

| Run No. | Product of Stream | Distribution (% of total in feed) $CaCO_3$ | $MgCO_3$ | $Fe_2O_3$ | $SiO_2$ | Product % $CaCo_3$ |
|---|---|---|---|---|---|---|
| 122 | Lime Conc. | 85.3 | 79.4 | 36.1 | 59.4 | 88.7 |
| | Waste | 14.7 | 20.6 | 63.9 | 40.6 | 71.1 |
| 123 | Lime Conc. | 92.7 | 89.8 | 57.1 | 72.3 | 89.3 |
| | Waste | 7.3 | 10.2 | 42.9 | 27.7 | 68.7 |
| 125 | Lime Conc. | 79.7 | 68.0 | 39.0 | 4.13 | 89.8 |
| | Waste | 20.3 | 32.0 | 61.0 | 58.7 | 69.7 |
| 126 | Lime Conc. | 65.8 | 54.5 | 9.3 | 41.8 | 90.0 |
| | Waste | 34.2 | 45.5 | 90.7 | 58.2 | 72.6 |
| 127 | Lime Conc. | 43.6 | 25.8 | 4.0 | 23.3 | 92.1 |
| | Waste | 56.4 | 74.2 | 96.0 | 76.7 | 79.9 |
| 128 | Lime Conc. | 57.5 | 37.2 | 8.9 | 30.4 | 91.0 |
| | Waste | 42.5 | 62.8 | 91.1 | 69.6 | 70.4 |

This demonstrates that impurities in the fluorescent surface-selective agent can influence its usefulness in selectively coating ore particles.

EXAMPLE VI

Large-scale production of 4-(fluoranthyl)-butanoic acid was undertaken in a 1000 gallon glass-lined jacketed reactor, equipped with an agitator, into which 550 lb. of fluoranthene, 660 gallons of 2-nitropropane and 275 lb. of succinic anhydride was placed. A temperature of about 10° C. was obtained by circulating cooling brine through the jacket, and then 811 lb. of aluminum chloride was added in 50 to 100 lb. aliquots over a period of about 3.5 hours, such that the temperature did not exceed 20° C. A slight vacuum was used to remove oxides of nitrogen. The mixture was stirred overnight.

A quench solution was prepared in a 2500 gallon agitated, resin-lined vessel by adding 200 gallons of 10 N hydrochloric acid to 200 gallons of water and 2000 lb. of ice. The reaction mixture, above, was added to the quench solution at a rate of about 10 to 15 gallons per minute, and an additional 700 lb. of ice was also added, resulting in a final temperature of about 30° C. This mixture was stirred for about two hours, forming a three phase slurry of solids dispersed in organic and aqueous liquid phases.

About one-third of the solids were isolated by a slow filtration, yielding a very wet cake. Due to the highly unsatisfactory filtering rate, the solids and filtrate were returned to the quench vessel, and the organic solvent was removed by steam distillation. The remaining aqueous slurry filtered rapidly, yielding 958 lb. of wet solids.

The solids were stirred into a solution containing two parts acetone to one part water, and sufficient sodium hydroxide to provide about 10% in excess over that needed to dissolve the 4-(fluoranthyl)-4-oxobutanoic acid product. Insoluble tars were removed by filtration, and dilute hydrochloric acid was used to re-precipitate the acid product. After filtration, the solids were subjected to an additional dissolution in base and precipitation with acid, as described above, resulting in a purified material.

A 109 lb. portion of the purified material was placed in the 1000 gallon jacketed reactor with about 45 gallons of diethylene glycol. The mixture was stirred and 46 lb. of potassium hydroxide and 43 lb. of hydrazine hydrate were added. Steam was passed through the jacket to obtain a temperature of about 120° C., and then the temperature was increased to 155° C. A nitrogen purge was used to maintain an oxygen content less than about 1% and a distillation receiver was used to collect the water and excess hydrazine which distilled from the reactor.

After cooling to about 25° C., the mixture was diluted with 110 gallons of water and acidified with 12 gallons of 10 N hydrochloric acid in about 50 gallons of water. The solid 4-(fluoranthyl)-butanoic acid which formed was collected on a filter.

A sample of this product was tested in a pilot plant, as an Example III, using a different limestone ore feed material, and yielding the following results for a total of 406 lb. of feed:

| Run No. | Product of Stream | Distribution (% of total in feed) $CaCO_3$ | $MgCO_3$ | $Fe_2O_3$ | $SiO_2$ | Product % $CaCO_3$ |
|---|---|---|---|---|---|---|
| 243 | Lime Conc. | 36.6 | 20.8 | 6.3 | 22.0 | 90.0 |
| | Waste | 63.4 | 79.2 | 93.7 | 78.0 | 82.3 |
| 244 | Lime Conc. | 49.4 | 32.9 | 4.3 | 24.0 | 91.4 |
| | Waste | 50.6 | 67.1 | 95.7 | 76.0 | 81.8 |
| 247 | Lime Conc. | 55.5 | 34.2 | 2.6 | 20.2 | 91.5 |
| | Waste | 44.8 | 65.8 | 97.4 | 79.8 | 80.5 |

EXAMPLE VII

A fluorescent compound containing a cationic surfactant group, 7-diethylamino-4-methylcoumarin, acid sulfate was prepared by dissolving the commercially available amine in sulfuric acid and diluting to a 0.24% by weight solution. This solution was evaluated for its ability to selectively coat minerals by the immersion of a clean mineral specimen in the solution for about 15 seconds, followed by rinsing of the specimen under running water and visual examination of the specimen under an ultraviolet light. The results were as follows:

| Mineral | Fluorescent intensity |
|---|---|
| Quartzite, $SiO_2$ | medium |
| Albite, $NaAlSi_3O_8$ | medium |
| Wollastonite, $CaSiO_3$ | strong |
| Quartz, $SiO_2$ | medium |
| Calcite, $CaCO_3$ | strong |
| Pyrite, (from coal), $FeS_2$ | strong |
| Oil Shale (<10 gal/ton) | medium |
| Oil Shale (>25 gal/ton) | none |
| Coal | none |
| Chert, $SiO_2$ | none |
| Slate | none |

The results show that the following economically significant separations can be made using this compound as a surface-selective agent with a technique as in Example III:

1. Coal can be separated from inorganic materials such as pyrite.
2. Higher grade oil shale can be separated from lower grade oil shale.
3. Wollastonite can be separated from other silicates, such as albite and quartz.
4. Quartz can be separated from calcite.

EXAMPLE VIII

To more quantitatively test the separation technique for oil shale, the following experiment was conducted: a solution of 4.0 g of 7-diethylamino-4-methylcoumarin, acid sulfate was made in 2 liters of deionized water, giving a pH of about 1.5. Oil shale particles having a size in the range of about one to about two inches were immersed in the clear yellow solution, rinsed with deionized water and visually examined under an ultraviolet light. The more fluorescent particles were separated from the less fluorescent particles, and the two fractions were crushed for oil analysis by the Fischer assay.

Barrel 27 is a high grade oil shale with an oil analysis which averages about 25 gal/ton. Barrel 187 is a low grade material which analyzes in the range of 8 to 11 gal/ton.

The following results obtained from the experiment, show the fraction weights, number of particles in the fraction, and oil content of each fraction:

| Barrel | Higher Fluorescence Weight | Particles | gal/ton | Weak Fluorescence Weight | Particles | gal/ton |
|---|---|---|---|---|---|---|
| 27 | 1073g | 15 | 0.9 | 258g | 5 | 46.1 |
| 187 | 862g | 20 | 7.3 | 513g | 12 | 19.2 |

Another experiment was performed, using 644 g (8 particles) from barrel 27 and 548 g (10 particles) from barrel 187, which were mixed and treated as above. These were 12 particles (674 g) with weak fluorescence, assaying 37.1 gal/ton, and 6 particles (519 g) with higher fluorescence which contained 8.8 gal/ton of oil.

Each of these experiments shows that a substantial ungrading can be obtained by selectively labeling oil shale particles.

EXAMPLE IX

A cationic derivative of 4-(fluoranthyl-butanoic acid was prepared by reaction with diethylenetriamine, using diethylene glycol as a solvent, according to the following reaction:

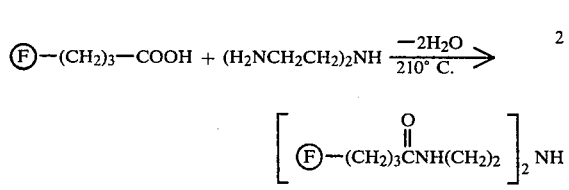

That portion of the reaction product which was insoluble in dilute sodium hydroxide was extracted with dilute acetic acid, and the resulting solution evaluated for coating minerals.

Mineral specimens were immersed in the solution for 20 to 30 seconds, rinsed with deionized water and visually examined under ultraviolet light, yielding the following results:

| Mineral | Fluorescent intensity |
|---|---|
| Chert, $SiO_2$ | moderate |
| Microcline, $KAlSiO_3O_8$ | moderate |
| Wollastonite, $CaSiO_3$ | strong |
| Limestone, $CaMg(CO_3)_2$ | weak |

These results show utility of the compound as a surface-selective agent for sorting mixtures of silicate minerals. This type of surface-selective compound can be viewed as effective over the entire aqueous pH range, an important property due to the influence of pH on the adherence of collectors to ore surfaces, a phenomenon which has been observed in the ore flotation art. With cationic fluorescent compounds, a structure can be chosen for its usefulness in a given pH range, e.g. amine salts containing the -NH+ group will be useful in the pH range dictated by the basicity of the amine, while quaternary amine salts will be useful over the entire pH range.

EXAMPLE X

In a manner similar to that of Example IX, the compound Ⓕ— $(CH_2)_3$ $CONH(CH_2)_2$ $NH_2$ was prepared by the reaction of 4-(Fluoranthyl)-butanoic acid and ethylene diamine in a diethylene glycol solvent, and precipitated by dilute sodium hydroxide. The product was extracted with a toluene-isopropanol mixture, and the extract was concentrated by distillation and, finally, evaporation of the solvents. After dispersal in water, the product was filtered and dried over phosphorus pentoxide, then dissolved in dilute acetic acid for coating experiments.

A specimen of microcline was coated by immersion in the acetic acid solution, but its visual fluorescence appeared to be too weak for a practical separation process. An activation step was conducted on a second specimen by immersion in a 0.4% solution of hydrofluoric acid for about 10 seconds, followed by a deionized water rinse. After activation, the fluorescent surface-active agent coating yielded a more intense fluorescence, indicating that the activating step could be used to advantage.

Several mineral specimens were immersed in the acetic acid solution (at about pH 5) for 10 to 15 seconds, rinsed with deionized water, and visually examined under ultraviolet light, giving the following results:

| Mineral | Fluorescent intensity |
|---|---|
| Quartzite, $SiO_2$ | moderate |
| Albite, $NaALSiO_3O_8$ | moderate |
| Wollastonite, $CaSiO_3$ | strong |
| Gneiss | moderate |
| Diopside, $CaMg(SiO_3)_2$ | waek |
| Chert, $SiO_2$ | weak |

A separate test was conducted by simultaneously immersing samples of quartzite and limestone in the acetic acid solution (at about pH 3). The samples were removed, rinsed and evaluated under ultraviolet light. Selectivity of the coating was shown by the somewhat more intense fluorescence of quartzite relative to limestone.

Visible fluorescence is a desirable property for the rapid evaluation of a surface-selective agent, and is also convenient for plant operators to use in empirical quality control checks of a separation process. However, an agent having no visible-region fluorescence or only a weak visible fluorescence can be quite useful in those processes which detect fluorescence by means of an electro-optical instrument, since the wavelength to which such an instrument responds can be altered as required.

What is claimed is:

1. A process for separating ore particles from gangue particles, comprising the steps of:
   a. conditioning the particles with a conditioning agent comprising a compound having both a surface-selective functional group and a detectable moiety, to selectively coat either
      i. at least a portion of the ore particles or
      ii. at least a portion of the gangue particles to the substantial exclusion of the other;
   b. detecting the coated particles; and
   c. separating the detected, coated particles from the substantially uncoated particles.

2. A process for separating ore particles, which include relatively higher grade ore particles and relatively lower grade ore particles, from gangue particles comprising the steps of:
   a. conditioning the particles with a conditioning agent comprising a compound having both a surface-selective functional group and a fluorescent moiety, which renders the compound fluorescent when exposed to external radiation, to selectively coat either
      i. at least a portion of the ore particles or
      ii. at least a portion of the gangue particles to the substantial exclusion of the other;
   b. irradiating the conditioned particles to excite and induce fluorescence of the conditioning agent to a degree sufficient for distinguishing the coated particles from the substantially uncoated particles; and
   c. separating the fluorescing, coated particles from the substantially uncoated particles.

3. A process as in claim 2, in which coated higher grade ore particles are distinguished and separated from lesser coated lower grade ore particles and the substantially uncoated gangue particles.

4. A process as in claim 2, in which coated gangue particles and lesser coated lower grade ore particles are distinguished and separated from substantially uncoated higher grade ore particles.

5. A process as in claim 2, in which the surface-selective group comprises a cationic surfactant.

6. A process as in claim 2, in which the surface-selective group comprises an anionic surfactant.

7. A process as in claim 2, in which the surface-selective group comprises a nonionic surfactant.

8. A process as in claim 2, in which the surface-active group comprises an amphoteric surfactant.

9. A process as in claim 2, in which the fluorescent moiety comprises a polynuclear aromatic group.

10. A process as in claim 2, wherein the particles have a size in the range of from about one-fourth inch to about eight inches.

11. A process as in claim 2, wherein the particles have a size in the range of from about one-half inch to about four inches.

12. A process as in claim 2, further comprising dissolving the conditioning agent in water.

13. A process as in claim 12, wherein the conditioning comprises immersing the particles in an aqueous solution of the conditioning agent.

14. A process as in claim 12, wherein the conditioning comprises spraying the particles with an aqueous solution of the conditioning agent.

15. A process for separating higher grade ore particles from lower grade ore particles and gangue particles, comprising the steps of:
   a. conditioning the particles by spraying with an aqueous solution of a conditioning agent, said conditioning agent comprising a compound having both a surface-selective functional group and a fluorescent moiety which renders the compound fluorescent when exposed to external radiation thereby selectively coating the ore particles in a degree dependent upon the grade of the ore, to the substantial exclusion of the gangue particles;
   b. irradiating the conditioned particles to excite and induce fluorescence of the conditioning agent for distinguishing among coated particles and coated particles from substantially uncoated particles; and
   c. separating fluorescing, higher grade ore particles from lesser fluorescing, lower grade ore particles and substantially uncoated gangue particles.

16. A process for separating higher grade ore particles from lower grade ore particles and gangue particles, comprising the steps of:
   a. conditioning the particles by spraying with an aqueous solution of a conditioning agent, said conditioning agent comprising a compound having both a surface-selective functional group and a fluorescent moiety which renders the compound fluorescent when exposed to external radiation, thereby selectively coating the gangue particles and, to a lesser degree, the lower grade ore particles, to the substantial exclusion of the higher grade ore particles;
   b. irradiating the conditioned particles to excite and induce fluorescence of the conditioning agent for distinguishing among the coated particles and coated particles from substantially uncoated particles; and
   c. separating fluorescing gangue particles and lesser fluorescing, lower grade ore particles from substantially uncoated higher grade ore particles.

17. A process for separating higher grade oil shale particles from lower grade oil shale particles, comprising the steps of:
   a. conditioning the oil shale particles by spraying with an aqueous solution of a conditioning agent comprising 7-diethylamino-4-methylcoumarin acid sulfate having both a surface-selective functional group and a fluorescent moiety which renders the conditioning agent fluorescent when exposed to external radiation, thereby selectively coating the lower grade oil shale particles and coating to a lesser degree the higher grade oil shale particles;
   b. irradiating the conditioned oil shale particles to excite and induce fluorescence of the conditioning agent to a degree sufficient for distinguishing among the coated oil shale particles; and
   c. separating the fluorescing lower grade oil shale particles from lesser fluorescing higher grade oil shale particles.

18. A process for separating higher grade coal particles from lower grade coal particles and pyrite particles, comprising the steps of:

a. conditioning the coal particles by spraying with an aqueous solution of a conditioning agent comprising 7-diethylamino-4-methylcoumarin acid sulfate having both a surface-selective functional group and a fluorescent moiety which renders the conditioning agent fluorescent when exposed to external radiation, thereby selectively coating the pyrite particles and, to a lesser degree, lower grade coal particles containing pyrite, to the substantial exclusion of the higher grade coal particles;

b. irradiating the conditioned coal particles to excite and induce fluorescence of the conditioning agent to a degree sufficient for distinguishing the coated particles from the substantially uncoated particles; and c. separating the fluorescing pyrite particles and the lesser fluorescing, lower grade coal particles from the substantially uncoated higher grade coal particles.

19. A process for separating higher grade calcite particles from lower grade calcite particles and siliceous gangue particles, comprising the steps of:

a. conditioning the particles by spraying with an aqueous solution of a conditioning agent comprising 7-diethylamino-4-methylcoumarin acid sulfate having both a surface-selective functional group and a fluorescent moiety which renders the conditioning agent fluorescent when exposed to external radiation thereby selectively coating the calcite particles in a degree dependent upon the grade of the calcite particle, to the substantial exclusion of the siliceous gangue particles;

b. irradiating the conditioned particles to excite and induce fluorescence of the conditioning agent to a degree sufficient for distinguishing the coated particles from the substantially uncoated particles; and c. separating the fluorescing, higher grade calcite particles from the lesser fluorescing, lower grade calcite particles and the substantially uncoated siliceous gangue particles.

20. A process for separating higher grade wollastonite ore particles from lower grade wollastonite ore particles and siliceous gangue particles, comprising the steps of:

a. conditioning the particles by spraying with an aqueous solution of a conditioning agent comprising 7-diethylamino-4-methylcoumarin acid sulfate having both a surface-selective functional group and a fluorescent moiety which renders the conditioning agent fluorescent when exposed to external radiation thereby selectively coating the wollastonite ore particles in a degree dependent upon the grade of the wollastonite ore, to the substantial exclusion of the siliceous gangue particles;

b. irradiating the conditioned particles to excite and induce fluorescence of the conditioning agent to a degree sufficient for distinguishing the coated particles from the substantially uncoated particles; and c. separating the fluorescing, higher grade wollastonite ore particles from the lesser fluorescing, lower grade wollastonite ore particles and the substantially uncoated siliceous gangue particles.

* * * * *